US008256986B2

(12) United States Patent
Casters

(10) Patent No.: US 8,256,986 B2
(45) Date of Patent: Sep. 4, 2012

(54) MACHINE FOR PAVING CONCRETE PATHS

(75) Inventor: François Joseph Casters, Opglabbeek (BE)

(73) Assignee: B.V.B.A. Consulting Casters, Opglabbeek (BE)

( * ) Notice: Subject to any disclaimer, the term of this patent is extended or adjusted under 35 U.S.C. 154(b) by 25 days.

(21) Appl. No.: 12/738,384

(22) PCT Filed: Nov. 4, 2008

(86) PCT No.: PCT/EP2008/009269

§ 371 (c)(1),
(2), (4) Date: Jun. 7, 2010

(87) PCT Pub. No.: WO2009/059734

PCT Pub. Date: May 14, 2009

(65) Prior Publication Data

US 2010/0247241 A1 Sep. 30, 2010

(30) Foreign Application Priority Data

Nov. 5, 2007 (NL) ..... 1034632

(51) Int. Cl.
*E01C 19/22* (2006.01)

(52) U.S. Cl. ..... 404/96; 404/104; 404/118

(58) Field of Classification Search ..... 404/96, 404/102, 104, 118, 105
See application file for complete search history.

(56) References Cited

U.S. PATENT DOCUMENTS

| | | | | |
|---|---|---|---|---|
| 3,533,337 | A * | 10/1970 | Swisher, Jr. et al. | 404/102 |
| 4,379,653 | A * | 4/1983 | Brown | 404/118 |
| 4,749,304 | A | 6/1988 | Craig | |
| 4,778,305 | A * | 10/1988 | Ritchey et al. | 404/105 |
| 4,900,186 | A * | 2/1990 | Swisher et al. | 404/105 |
| 5,039,249 | A | 8/1991 | Hansen et al. | |
| 5,224,793 | A * | 7/1993 | De Pol et al. | 404/119 |
| 5,857,804 | A * | 1/1999 | Musil | 404/104 |
| 6,582,152 | B2 * | 6/2003 | Leone et al. | 404/75 |
| 7,311,465 | B2 * | 12/2007 | Guntert et al. | 404/105 |
| 2002/0044831 | A1 | 4/2002 | Leone et al. | |

FOREIGN PATENT DOCUMENTS

| | | |
|---|---|---|
| DE | 44 08 282 | 9/1995 |
| WO | 95/28525 | 10/1995 |

OTHER PUBLICATIONS

International Search Report issued Mar. 2, 2009 in International (PCT) Application No. PCT/EP2008/009269.

Written Opinion of the International Searching Authority issued Mar. 2, 2009 in International (PCT) Application No. PCT/EP2008/009269.

* cited by examiner

*Primary Examiner* — Gary S Hartmann
(74) *Attorney, Agent, or Firm* — Dinsmore & Shohl LLP

(57) ABSTRACT

A machine for paving concrete paths, of the type in which a concrete mix, in a plastic condition, is spread over a certain width, and is then levelled to a certain height. The machine includes a tractor and a levelling section connected to it, wherein the working width of the tractor and levelling section are adjustable and wherein the adjustment of the working width of the tractor is independent of the adjustment of the working width of the levelling section. The tractor is provided with an element whose width is adjustable and which distributes the concrete mix over a certain width and to a certain height.

22 Claims, 6 Drawing Sheets

MACHINE FOR PAVING CONCRETE PATHS

BACKGROUND OF THE INVENTION

1. Field of the Invention

The invention relates to a machine for paving concrete paths of the type in which a concrete mix, in a plastic condition, is spread over a certain width and is then levelled to a certain height, the machine consisting of a tractor section and a levelling section connected thereto.

2. State of the Prior Art

Such a device is known from WO-A-95/28525.

In this machine of the prior art the tractor section and the levelling section form one whole, the width of which can be adjusted to the width of the concrete path to be paved.

This machine of the prior art has in itself given great satisfaction and is still used to a large extent. Nevertheless there are some problems associated with the use of this machine. A first problem arises because it is always necessary to have space along the concrete path to be paved. This space is not always available due, for example, to the presence of buildings or plants immediately adjacent to the concrete path to be paved. Another difficulty arises when paving larger surfaces such as squares or wider paths. Here the work must always be carried out in such a manner that after a first strip is paved, the second adjacent strip must be temporarily omitted, but the third strip must be started. The second strip cannot then be paved until the first and second strips have sufficiently hardened. This often results in a loss of time due to the hardening time and may make it impossible for the side edge drop-off to be removed. Finally, the machine is difficult to control and drive when paving curves.

SUMMARY OF THE INVENTION

The object of the invention is to provide a machine of the above-mentioned type in which the above drawbacks are avoided.

This object is achieved according to the invention in that the adjustment of the working width of the tractor is independent of the adjustment of the working width of the levelling section.

Because the working width of both sections is made independent of each other, it is possible to make the working width of the tractor smaller than the working width of the levelling section, or vice versa, thus enabling the above-mentioned problems to be avoided or considerably reduced.

BRIEF DESCRIPTION OF THE DRAWINGS

Other features and advantages will become clear from the following description in which reference is made to the attached drawings, in which.

DETAILED DESCRIPTION OF THE PREFERRED EMBODIMENT

Figure 1:
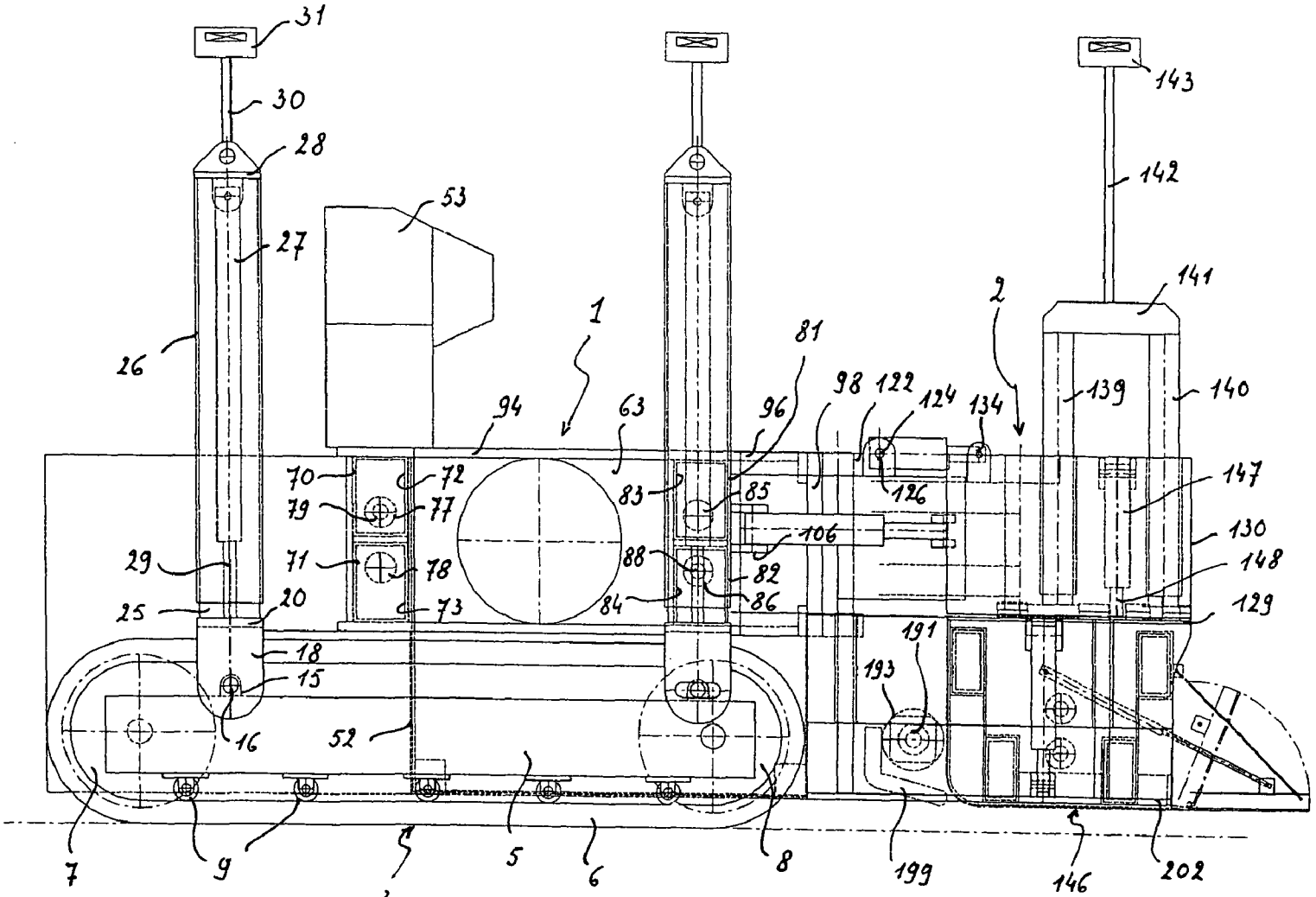
FIG. 1 shows a side view of a machine according to the invention.

As shown in FIG. 1, the machine according to the invention consists of two sections, tractor section 1 and levelling section

2. Tractor section 1 is a section that is displaceable by means of two caterpillar mechanisms 3, 4, whilst levelling section 2 is a section coupled to the track section that does not have its own driving means but is propelled together with the tractor section. In the following description reference is made to horizontal and vertical directions, horizontal coinciding with the plane of the tread of caterpillar mechanisms 3, 4, and the vertical plane referring to the plane that is perpendicular to it.

Each caterpillar mechanism 3 is mounted on two frame plates which lie on both sides of caterpillar mechanism 3 and are incorporated inside caterpillar track 6. FIG. 1 only shows frame plate 5, the frame plates being mounted on the axles of driving wheel 7 and tensioning wheel 8 of caterpillar track 6, whilst gauge wheels 9 are mounted against the underside of frame plates 5.

Two vertical columns 10, 11 and 12, 13 respectively are mounted above each caterpillar mechanism 3, 4. Vertical columns 10, 11, 12, 13 are identical and only the structure of vertical column 10 will be described in more detail below.

A bracket (only bracket 15 is shown in FIG. 1) is fitted to the top of each of the frame plates belonging to caterpillar track 3 level with column 10, each of which brackets supports an axle journal projecting from the caterpillar track (only axle journal 16 is visible in FIG. 1). A largely U-shaped profile 17 is mounted on these axle journals 16 in a downward direction, two flange plates 18, 19 of which profile 17 extend along both sides of caterpillar track 3. In this case flange plate 18, which is located on the outside of the machine, is much shorter than the flange plate 19. Flange plate 18 therefore extends to a point just above the level of the axles of driving wheel 7 and tensioning wheel 8 of caterpillar mechanism 3, whilst flange plate 19 extends to a point just above the level of the supporting face of caterpillar track 6.

A tube end 25, which extends vertically upwards, is mounted on web 20 of profile 17. Over tube end 25 is pushed a tube end 26 whose inner circumference almost coincides with the outer circumference of tube end 25 so that the two tube ends are able to slide over each other telescopically.

Inside tube ends 25, 26 pushed over each other is mounted a hydraulic cylinder piston system consisting of a cylinder 27 whose closed end is articulated to a plate 28 which seals the top of tube end 26, and a piston which is connected by a piston rod 29 to web 20. On plate 28 a vertical rod 30 is mounted on the top, a detection system 31 of which is fitted by means of which the height of system 31 can be adjusted to external reference systems. Such systems are generally known in this type of machine and will not be described in further detail here. By means of the piston cylinder system 27, 29 it is possible to adjust the height of tube end 26 relative to tube end 25 and hence relative to the ground level, wherein this height adjustment can be controlled by means of detection system 31.

As already stated, the four columns 10, 11, 12 and 13 are identical and each of the four columns is therefore also provided with a piston cylinder system and means for detecting the height.

Figure 2:
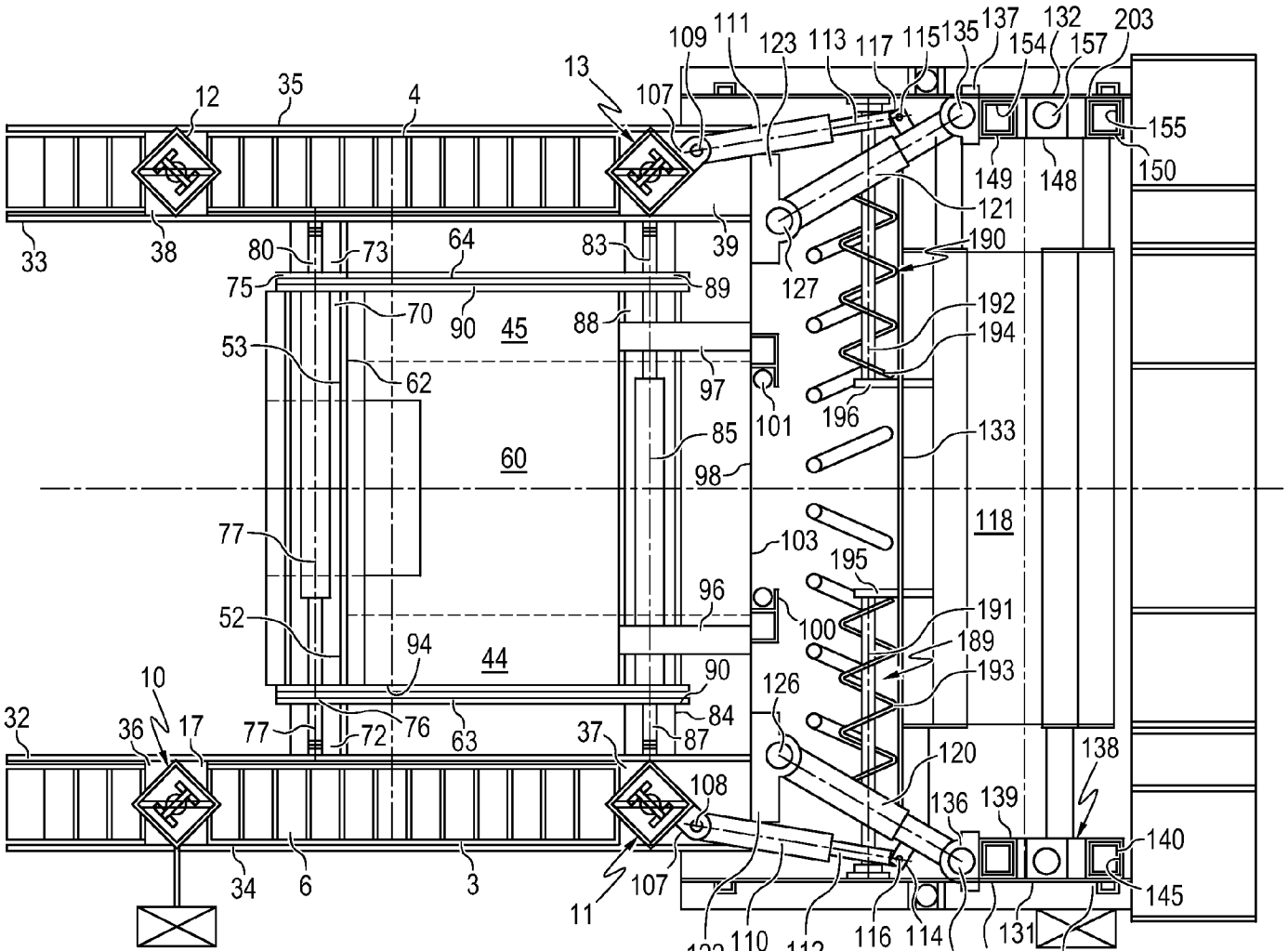
FIG. 2 shows an elevation of the machine in FIG. 1.

As shown in FIG. 2, columns 10, 11, 12 and 13 have a square cross-section. In principle they may assume a different cross-sectional shape, but because a square cross-section is used, where the diagonals of the square are perpendicular and parallel to the direction of movement of the machine, greater stability is obtained during the movement of the machine.

Figure 3:
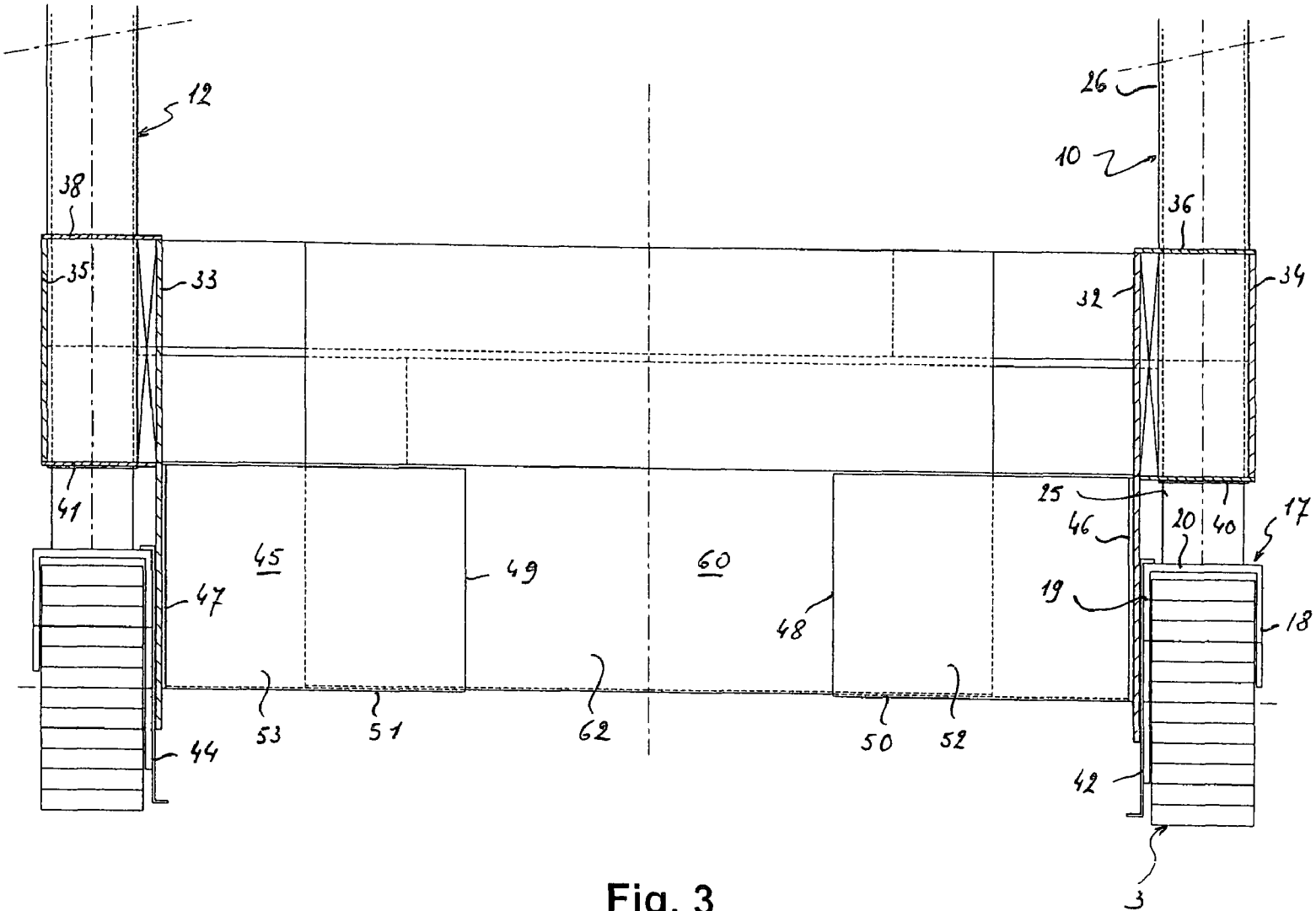
FIG. 3 shows a front view of the machine in FIG. 1.

Plates 32 and 33 respectively are secured to the sides facing each other on the inner sides of columns 10, 11 and 12, 13 respectively. Plates 32 and 33 are in this case welded directly to the diagonals of columns 10, 11, 12 and 13. Plates 34 and 35 respectively are also secured to the sides of columns 10, 11 and 12, 13 respectively, these sides facing away from each other, by welding to the diagonals of columns 10, 11, 12 and 13. Plates 32, 33, 34 and 35 are rectangular in shape, two edges of each plate lying in a horizontal plane and the other two edges being vertically directed. In this case the upper edges of plates 32, 34 and 33, 35 respectively are connected by means of plates 36, 37 and 38, 39 respectively, both level with columns 10, 11 and 12, 13 respectively. The vertical dimension of plates 32 and 33 is greater than that of plates 34, 35, the lower edge of plates 32, 33 lying approximately at the same height of the as the axles of driving wheels 7 and running wheels 8, whilst the lower edge of plates 34 and 35 lies at a certain height above the level of flange plate 20. The lower edge of plates 34, 35 is connected by means of horizontal plates 40, 41 to plates 32, 33, which are therefore parallel to plates 36, 37, 38 and 39. FIG. 3 shows only plates 40 and 41, but similar plates are located level with columns 11 and 13.

Plates 36, 37, 38, 39, 40 and 41 are all provided with a rectangular recess through which extend columns 10, 11, 12 and 13, and are in this case connected by welding to tube ends 26 belonging to these columns so that all plates 32, 33, 34 and 35 follow the movements of tube ends 26.

Between plate 32 and flange plate 19 is fitted a plate 42 which is fixedly connected to flange plate 19 and which extends from the top of caterpillar mechanism 3 almost to the level of the bottom over which caterpillar track 6 is displaced. This plate 42 serves as a lateral limit for the concrete which is poured in front of the machine and is to be processed by the machine into concrete paths so that the machine does not end up directly below caterpillar track 6. Plate 42 extends over the entire length of the tractor section and is also connected to the innermost flanged section of the U-profile which column 11 supports. Similarly such a plate 43 is mounted on the side of columns 12, 13 so that on the side of caterpillar mechanism 4 the concrete is also kept to the side inside the machine.

A U-shaped profile 44, 45 is mounted on each of the inner sides of plates 32, 33 facing towards each other close to the lower edge thereof. U-shaped profiles 44, 45 are secured to plates 32 with a head end 46, 47, and the other ends 48, 49 of these profiles, located at a certain distance from each other, the function of which will be explained later. The U-shaped profiles consist of a web 44, 45, which is horizontally directed, and two flange plates, only the leading flange plates 46, 47 being visible in FIG. 3.

Inside U-shaped profiles 44, 45 is placed a tray 60 in the shape of a parallelepiped which rests with its bottom plate on flange plates 52, 53 of U-shaped profiles 44, 45. Two parallel side walls (only side wall 62 is shown in FIG. 3) bear against the flange plates of U-shaped profiles 44, 45 so that tray 60 is laterally displaceable relative to the U-shaped profiles which at the same form a guide for tray 60.

Flange plates 52, 53 of the U-shaped profiles have horizontal upper edges which lie level with plates 40, 41 and corresponding plates of columns 11 and 13. Parallel side walls 62 of tray 60, on the other hand, have horizontal upper edges which lie at the level of plates 36, 37, 38 and 39. This means that the tray projects above the U-shaped profiles.

The two other side walls 63 and 64 of tray 60 therefore extend in the direction of movement of the machine. In the tray thus formed is incorporated the hydraulic drive for caterpillar mechanisms 3 and 4, as are the operating and control means 59 for operating the machine. This will not be described in greater detail because it is clear to the person skilled in the art, without further explanation, how this can be achieved.

Above flange plates 44, 45 and between plates 32, 33 are fitted eight rectangular tubes extend in the horizontal direction and are perpendicular to the plates 32, 33. One set of tubes has an inside diameter in which the other tubes have a sliding fit. One end of the one set of tubes is connected to plate 32, whilst one end of the other tubes is connected to plate 33. A system of four tubes that are telescopically displaceable into each other is formed which therefore interconnects plates 32 and 33, the plates nevertheless being free to move in parallel with each other.

A piston cylinder system is installed inside each pair of the telescopic tubes connected between plates 32, 33, the piston sections of two systems being connected to plate 32, whilst the piston sections of two systems being connected to plate 33. The cylinder sections of the first two systems, on the other hand, are connected to plate 34 and the other two cylinder sections are connected to plate 35. The piston cylinder systems are double acting, i.e. a hydraulic pressure can be generated on both sides of the piston in order to displace the piston to one or the other side relative to the associated cylinder.

At the height of columns 11 and 13 is fitted a second system of tubes 81, 82 which interact telescopically with tubes 83 and 84. Piston cylinder systems are fitted inside tube systems 81, 83 and 82, 84, these systems consisting of cylinders 85 and 86 respectively, and pistons with piston rods 87 and 88 respectively. Tubes 81, 82 are also provided with closing plates 89 and 90 respectively. The arrangement of the tube systems is such that in one pair of tubes positioned one above the other the piston cylinder system of the uppermost tube system acts on plates 32, 34, and in the other pair of tubes positioned one above the other the piston cylinder system of the bottommost tube acts on plates 33, 35 and vice versa.

Due to a suitable application of a hydraulic pressure in the piston cylinder systems in the tubes plates 32, 34 and 33, 35 can be moved away from each other and hence also can caterpillar mechanisms 3 and 4, so that tractor section 1 becomes wider or plates 32, 34 and 33, 35 can be displaced towards each other so that tractor section 1 becomes narrower. The tractor section can therefore be set in a continuous way to any desired width. During this movement tray 60 may be displaced inside U-shaped profiles 44 and 45, the bottom face and the leading face being formed by flange plates 44, 45 and side wall 62 continuing to form an almost closed surface.

Recesses through which tubes 72, 73 and 83, 84 can pass freely movably are installed in side walls 63 and 64 of tray 60, whilst these side walls can serve as a closing plate for tubes 70, 71 and 81, 82. Tubes 70, 71 and 81, 82 therefore form one whole.

To provide adequate rigidity, rods 90, 94 are fitted which connect the upper wall of tube 70 to the upper wall of tube 81. A second pair of rods 96, 97 connects the upper wall of tube 81 to the upper edge of vertical plate 98, which forms a rear wall of tray 60. Because of this construction spaces are freely maintained between plate 98, whose lower edge connects to bottom plate 61 and side walls 62 and 63, as a result of which the hydraulic pipes from the tray to the various hydraulic units can be guided outside the tray.

Close to the upper end and on the outside of tray 60, two piston cylinder systems 100, 101 can be mounted on rear wall 98 with a vertical action. The piston is in this case located near the upper edge of plate 98, whilst the downwardly projecting end of the piston rod is connected to a plate 103 which is parallel with plate 98 and can be displaced along the plate by means of the piston cylinder systems 100, 101.

Plate 103 has a rectangular shape and is located opposite the bottommost part of plate 98. Plate 103 can be displaced vertically up and down by means of piston cylinder systems 100 and 101, as a result of which the height of plate 103 can be adjusted and hence also the quantity of concrete which is admitted to the levelling section. U-shaped brackets 107 are fitted to the outwardly and rearwardly directed wall of the tube ends of columns 11 and 13, which tube end corresponds to tube end 16 of column 10, in which brackets are placed vertically directed rotary shafts 108, 109, which are connected to one end of a cylinder of a piston cylinder systems 110, 111 having ends of piston rods 112, 113 connected by means of brackets 114, 115 with vertical rotary shafts 116, 117 to a sub-frame 118.

Sub-frame 118 is also connected by means a second pair of piston cylinder systems 120, 121 to the rear ends of plates 32, 37 and 33, 39 respectively. For this purpose a support plate 122 is secured to the rear ends of plates 32, 37, and a support plate 123 is supported to the rear ends of plates 33, 39, to which support plates are fitted a bracket 124 and 125 respectively with horizontal rotary shafts 126, 127 as the fastening point of one of the ends of piston cylinder systems 120, 121. Support plates 122 and 123 may possibly also be secured to plate 98.

Sub-frame 118 consists of a tray in the shape of a parallelepiped, with a horizontal bottom 129, a vertical rear wall 130, two vertical side walls 131, 132, and a leading wall 133. The connection between leading wall 133 and side walls 131, 132 is formed by inclined wall sections to which brackets 116 and 117 are secured. The second ends of piston cylinder systems 120, 121 are connected to horizontal rotary shafts 134, 135 incorporated in brackets 136, 137, which are connected to tray 118. In this manner sub-frame 118 is connected in a rigid manner to the caterpillar tracks of tractor section 1.

A rectangular tube 138 is formed against the inside of side wall 131, which tube extends in the vertical direction above the height of side wall 131. Rectangular tube 138 lies with a side that is long in cross-section against the inside of side wall 131. Square tubes 139, 140 are formed inside tube 138 against each short side, which tubes also extend in the vertical direction and up to a certain height project above the level of side wall 131. The upper ends of tubes 139, 140 are interconnected by means of a bridge 141, which supports a vertical rod 142 on which a system 143 is positioned for, detecting the height.

Square tubes 144, 145 are incorporated in tubes 139 and 140 so that they have a sliding fit, which tubes project downwards outside tubes 139, 140, with their bottommost ends connected to a sub-frame 146 which is fitted under sub-frame 118 and which will be described in greater detail later. Between tubes 139, 140 there is a vertically directed piston cylinder system whose cylinder 147 is connected to tube 138 and where the downwardly projecting end of the piston rod is connected to sub-frame 146. In this manner the height of sub-frame 146, guided through tubes 139, 140 and 144, 145, can be displaced vertically up and down and can be adjusted to the desired height.

In a comparable manner a rectangular tube 148 is formed against the inside of side wall 132, in which tube two tubes 149 and 150 are fitted whose upper ends can be interconnected by means of a bridge which supports a vertical rod on which is positioned a system for detecting the height. Two tubes 154 and 155 are incorporated displaceably inside tubes 149, 150, and are connected with their lower ends to a sub-frame which is comparable to sub-frame 146. The movement of this sub-frame is controlled by means of a piston cylinder system 157.

Figure 4:
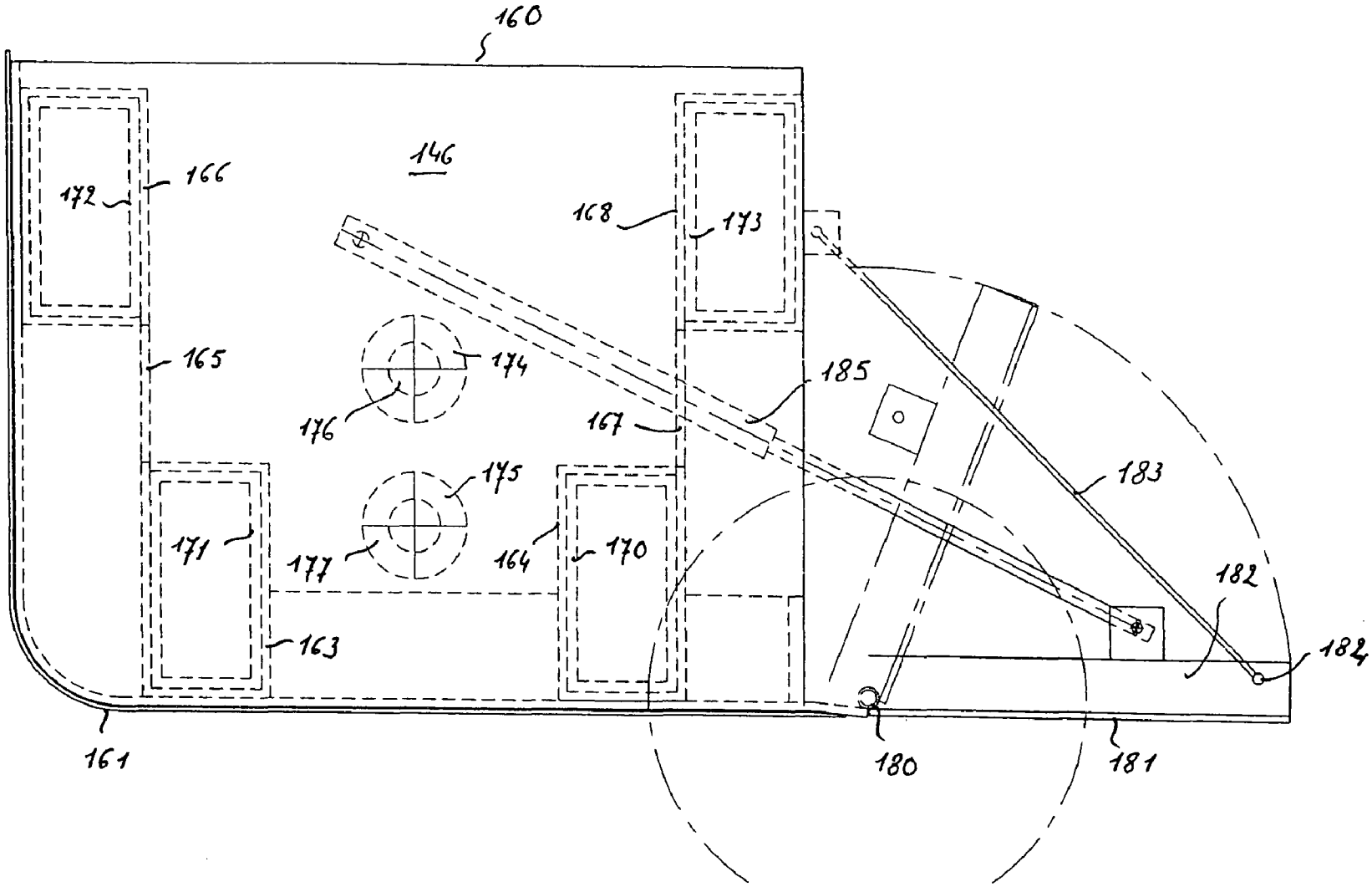
FIG. 4 shows a side view of the levelling system of the machine in FIG. 1.

Sub-frame 146 is shown in greater detail in FIG. 4. In practice the other sub-frame connected to side wall 132 is designed identically but is mirror symmetrical to it.

Sub-frame 146 consists of a vertical, mainly rectangular side wall 160 which lies underneath side wall 131. A bent plate 161 is secured to the vertical leading edge of the side wall and the lower wall, the angle between these two edges being rounded, which plate extends from the side wall up to a certain distance inside it. Plate 161 forms part of the levelling plate, as will be described below. Levelling plates 161 in the two sub-frames therefore lie opposite each other and together support a central levelling plate which rests on plates 161.

Two rectangular tubes 163 and 164 are mounted on the central levelling plate, for example by means of welding. These tubes are horizontally directed and are perpendicular to side walls 160 of sub-frames 146. A vertical plate 165 is secured to one of the vertical walls of tube 163, which plate extends close to the upper edge of side wall 160. A rectangular tube 166 is mounted near the upper edge on the other side of plate 165 relative to tube 163, which rectangular tube is orientated in exactly the same direction as tubes 163 and 164. In the same way a tube 167 is secured to a vertical side wall of tube 164, a tube 168 being mounted near the upper edge of plate 160 against plate 167, which tube lies on the other side of plate 167 relative to tube 164 and has the same orientation and construction. The four tubes 163, 164, 166 and 168 are similarly rigidly connected to the central levelling plate.

Rectangular tubes 170, 171, 172 and 173 are each incorporated inside the tubes so that they have a sliding fit, so that tubes 170, 171, 172 and 173 can be displaced horizontally inside tubes 163, 164, 166 and 168 and therefore form telescopic systems. The ends of tubes 171 and 173 projecting outside tubes 163 and 168 are connected to side wall 160 of sub-frame 146, whilst the ends of tubes 170 and 172 projecting outside tubes 164 and 166 are connected to the side wall of the other sub-frame.

Two cylinders 174, 175 of two cylinder piston systems are also connected to central levelling plate 162, but this connection is not shown in greater detail. The end of piston rod 176 belonging to cylinder 174 is connected to side wall 160, whilst the end of piston rod 177 belonging to cylinder 175 is connected to the side wall of the other sub-frame. It is possible, by means of the cylinder piston systems, to displace the sub-frames 146 laterally relative to the central section supporting levelling plate 162, and the width of levelling can therefore be steplessly adjusted by plates 161 and the central levelling plate. In this case plates 161 and the central levelling plate are constructed as described in more detail in the Dutch patent application in the name of the applicant and filed on Dec. 10, 2007. This applies particularly to the trailing end of levelling plates 161 and the central levelling plate, which are inclined so that the levelling height of plates 161 and the central levelling plate is the same.

A hinge 180, by means of which a finishing plate 181 is articulated, is mounted on the rear end of the central levelling plate. A number of reinforcing ribs 182, which keep plate 181 very flat, are fitted to the upper side of finishing plate 181. The finishing plate serves to correct minor irregularities which cannot be compensated for by the levelling plates, and extends over the maximum width of the machine. In this case finishing plate 181 is positioned slightly inclined with the leading edge slightly higher than the trailing edge.

In order to retain plate 181 further in the desired position, a chain or cord 183 is fitted which is on the one hand secured to the vertical rear edge of side wall 160, close to the upper end thereof, and on the other hand to a point 184 on the finishing plate in the vicinity of the rear end of plate 181. The inclination of plate 181 can be set by adjusting the length of the cord or chain 183. On the other hand plate 181 can be rotated away not only for possible maintenance or cleaning, but also in the event that n unexpected obstacle should be found in the concrete mass.

In order to apply sufficient pressure to the finishing plate 181 a piston cylinder system 185 is fitted between on the one hand side wall 160 and on the other hand plate 181. This system is positioned so that it exerts a certain pressure on plate 181, but it also enables the plate to be displaced in the presence of obstacles. This is possible by making use of so-called gas springs which allow compression of the gas and therefore turning away of plate 181. Instead of gas springs use can also be made of pressure-compensated hydraulic cylinders.

A number of devices are fitted in the space between plates 98, 103 and plates 133 and the vertical section of plates 161, 162 for homogenizing the concrete before it is levelled by plates 161, 162.

These devices consist on the one hand of two mixing screws 189 and 190. The mixing screws consist of a shaft 191 and 192 respectively, around which a rod 193 and 194 respectively is spirally wound. Shafts 191 and 192 are on the one hand rotatably mounted against side walls 131 and 132 respectively, and on the other hand are secured in brackets against sub-frames 146 and 156. Driving means for the rotary driving of shafts 191 and 192 are present but are not shown.

In addition vibrating bars 199 are fitted. The vibrating bars are bars consisting of a vertically suspended section, which extends to the rear viewed in the direction of movement of the machine. Each vibrating bar 199 is connected, with the upper end of the vertical section, to a resilient element that is further suspended by means of a bar, not shown, on either levelling walls 161 or on the central levelling plate. For this purpose collecting tubes are fitted behind the upper edge of those plates, in which tubes these bars can be suspended. At the minimum width of the machine all the vibrating bars will be suspended on levelling plates 161. If the machine is made wider, additional vibrating bars can be placed on the central levelling plate. The vibration of these vibrating bars 199 is obtained by the movement of the machine, but it is also possible to use hydraulically or electrically driven vibrating bars.

The operation of the machine is as follows:

The width of the tractor section and of the levelling section is adjusted according to the width of the concrete path to be paved. The width of the tractor section is adjusted in a continuous way by means of piston systems 77, 79; 78; 86, 88 and 85. The width chosen depends on the circumstances. In practice a width will often be chosen that is smaller than the concrete path to be paved since this guarantees a pavement free from obstacles. The height of tray 60 together with U-shaped profiles 44 and 45 is also adjusted. The adjustment is a function of the final desired thickness of the concrete path, as will be described below.

The width of levelling section 2 is also adjusted in a continuous way and independently from the width of the tractor section by reinforcing piston cylinder systems 174, 176 and 175, 177. This is adjusted as accurately as possible to the desired width, the particular advantage of the construction according to the invention consisting in the complete symmetry of the adjustment of the width, thereby improving the stability of the machine and quality of the end product. The thickness of the concrete path is also adjusted by means of piston cylinder system 147.

After these adjustments have been carried out the machine can be started. For the paving of a concrete path a quantity of concrete is poured in front of the machine, and the machine is then moves forwards and backwards over it. On the one hand plates 52, 53 and 62 will together push the uppermost part of the deposited concrete mass forwards, whilst on the other hand a quantity will be admitted underneath U-shaped profiles 44, 45 and tray 60. This pushing exerts a distributing effect on the concrete mass, so that it will also be spread width-wise. The adjustment of the height of U-shaped profiles 44, 45 and tray 60 is preferably chosen so that the quantity of concrete admitted is slightly higher than the quantity of concrete required to pave the concrete path. This also has a distributing effect width-wise on the concrete mass and surplus that is admitted is simply pushed forward through the mass of concrete present in front of levelling plates 161 the central levelling plate. Any deviations in the height of the machine relative to the wearing surface on which the concrete mass has to be spread and levelled can be compensated for by the height determinations and corrective height adjustments of U-shaped profiles 44, 45 and tray 60.

The concrete mass then attains the height of plate 103, which is adjusted to a height which corresponds very accurately to the quantities of concrete required to pave the concrete path. This can be achieved by continuously adjusting the height of plate 103 on the basis of a determination of the height of the concrete mass in the space between plate 103 and plate 133. In this space is placed, at a certain height, a height sensor which can be actuated by the concrete mass in this space. When the concrete mass in this space becomes too great, the height of the concrete mass rises and the sensor is actuated, as a result of which plate 103 is allowed to drop further and the quantity of concrete supplied to the space in which the sensor is placed is reduced. As soon as the height of the concrete mass in the space has dropped below a certain level, the sensor is no longer actuated and plate 103 will be displaced upwards causing the concrete mass admitted to rise again. The quantity of concrete in the space between plates 103 and 133 may therefore be kept almost constant, ensuring a highly uniform layer of concrete during the subsequent levelling of the concrete by means of levelling plates 161 the central levelling plate. In practice plate 103 is adjusted to a certain height that corresponds to the expected concrete consumption, and the control system will regulate variations around the adjustment by means of the sensor.

The concrete then passes underneath the levelling section, where the concrete is levelled flat because the end edges of levelling plates 161 the central levelling plate lie on the same horizontal line. Height variations of the machine can be compensated for by device 185, which adapts the height of the levelling plates and compensates for any local irregularities in height. By means of this machine not only is a concrete layer with a constant height applied in one operation, but the concrete mass is homogenised, spread and distributed in a highly efficient manner.

Because the entire machine is only provided with a single caterpillar mechanism, comprising two caterpillar track mechanisms, the machine can easily be additionally adjusted when the concrete path describes a curve. In the embodiment described and illustrated, an additional adjustment of the position of the levelling section can be obtained by correct actuation of piston cylinder systems 110, 112, 120, 111, 113 and 121. This should possibly be combined with the readjustment of the position of edge plates 202, 203 by means of piston cylinder systems 174, 176; 175, 177. This is an important advantage over the machines of prior art, all of which have a double caterpillar mechanism where such an additional adjustment in curves encounters considerable problems.

Figure 5:
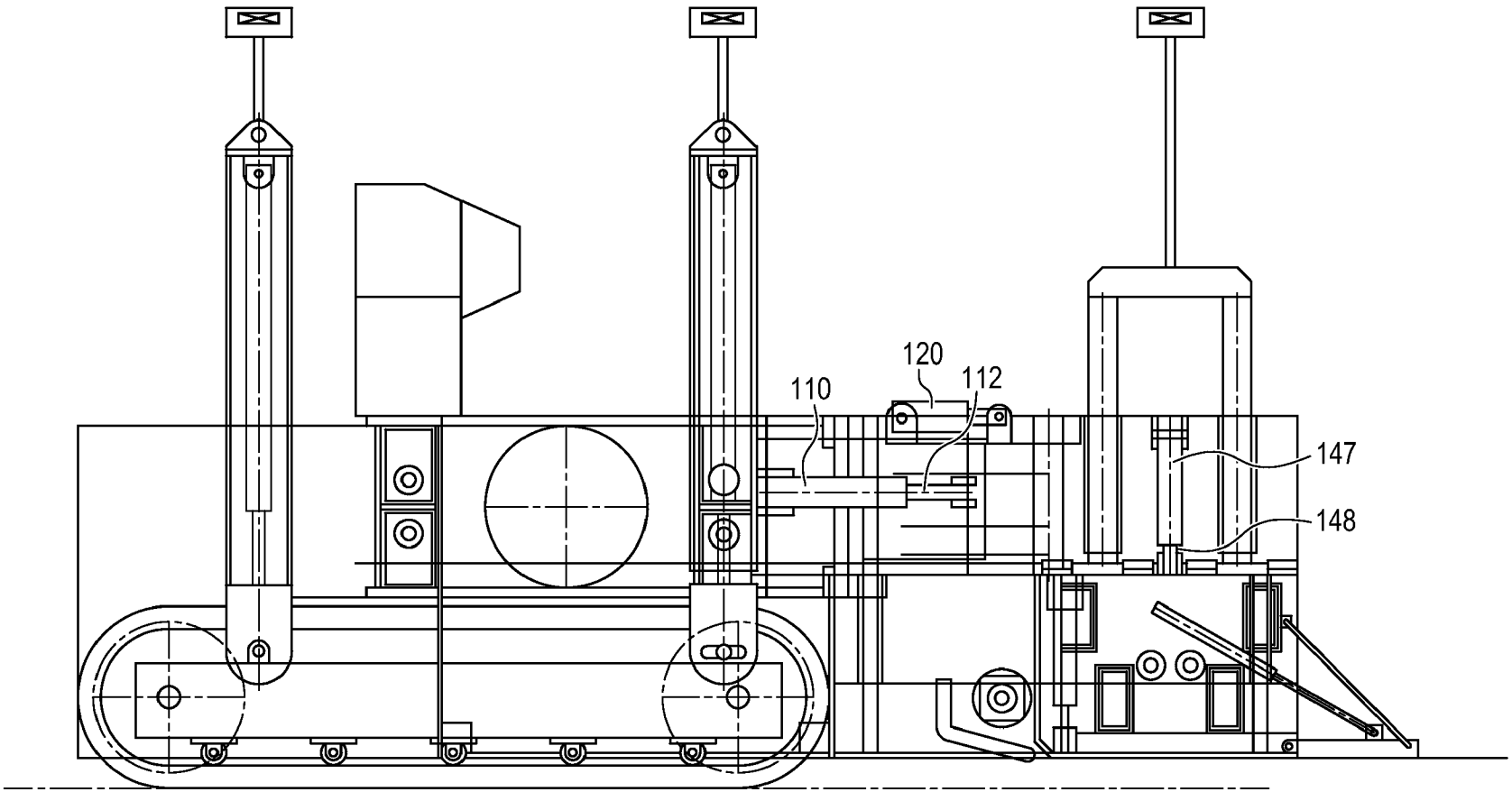
FIG. 5 shows a side view similar to that of FIG. 1 focusing on certain components of this machine.
Figure 6:
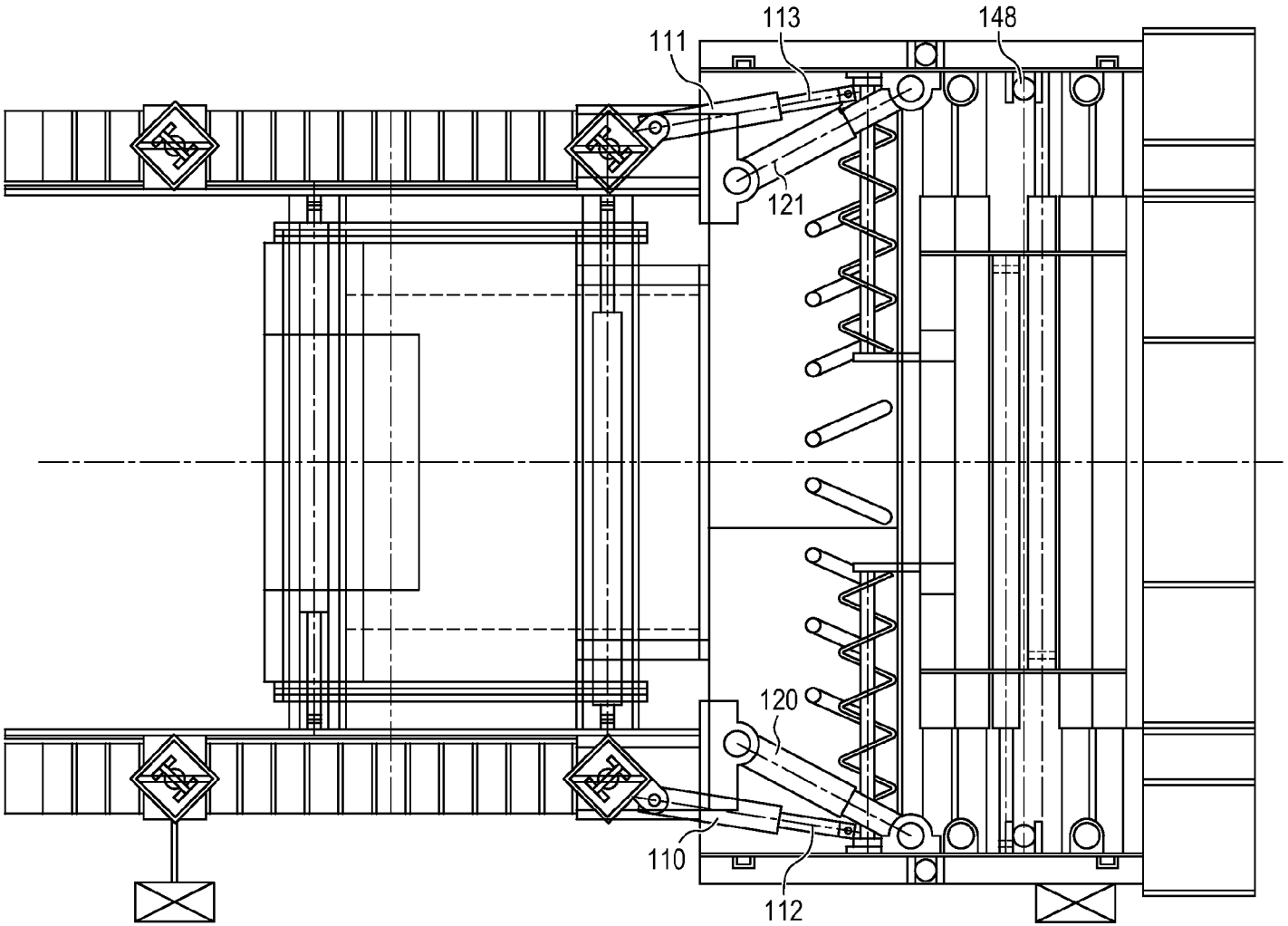
FIG. 6 shows an elevation view of the machine similar to FIG. 2, focusing on certain components of the machine.

FIGS. 5 and 6 illustrate the machine in a simplified manner, focusing on the piston cylinder systems 110, 112, 120, 111, 113 and 121. As is clear from the drawing figures and the mechanical arrangement that has been described so far, these piston cylinder systems allow the levelling section to not only be moved rearwardly relative to the tractor section (which is illustrated by comparing FIG. 6 with FIG. 2, for example), but also allows adjustment when a concrete path is describing a curve. That is, the levelling section can be adjusted relative to the tractor section by the piston cylinder systems 110, 112, 120, 111, 113 and 121 by, for example, extending piston 113 and retracting piston 112. This allows the levelling section to, for example, describe an angle with respect to the tractor section. It should also be noted that the levelling section, being suspended by the two pairs of piston cylinder systems 110, 112 and 120, and 111, 113 and 121, with a pair of the piston cylinder systems being fitted on each side, each piston cylinder system forms an angle with a direction of movement of the tractor. As can also be seen from FIG. 5, piston cylinder systems 147 at both ends of the paving pan enable further vertical adjustment of the paving pan independently of the tractor section. As a result, the orientation of the levelling section including the paving pan can be independently adjusted with the present invention with respect to the orientation of the tractor, not only in the vertical plane, but also in the horizontal plane.

A different design may be chosen for the additional adjustment of the levelling section in curves, the sub-frame being placed in a slewing ring which is connected, by means of a telescopic system that can be actuated by means of a piston cylinder system, to tray 60. Due to the extension and retraction of the telescopic system and the rotation of the slewing ring the levelling section can be kept in the correct orientation and position at all times. This system may provide particular advantages when GPS systems are used.

It is clear that the invention is not limited to the embodiment described and illustrated but that numerous modifications can be made within the scope of the claims.

The invention claimed is:

1. A machine for paving concrete paths with a concrete mix in a plastic condition spread over a certain width and levelled to a certain height, wherein the machine comprises a tractor and a levelling section connected to the tractor, and wherein the working width of the tractor and levelling section are adjustable, wherein the adjustment of the working width of the tractor is done in a continuous way and is independent of the adjustment of the working width of the levelling section, which is also done in a continuous way, and wherein the levelling section is suspended on the tractor by two pairs of piston cylinder systems including one pair of said two pairs of piston cylinder systems fitted on each side of said tractor and where each piston cylinder system of said two pairs of piston cylinder systems forms an angle with a direction of movement of the tractor.

2. The machine according to claim 1, wherein the tractor is provided with a levelling element whose width is adjustable, said element distributing concrete mix over a certain width and to a certain height.

3. The machine according to claim 2, wherein said the levelling element of the tractor comprises a fixed central section with a flat bottom plate which serves as a levelling plate for concrete mix, and two lateral plates which are located on both sides of the flat bottom plate and which are laterally displaceable relative to the flat bottom plate.

4. The machine according to claim 1, wherein the tractor is provided with a caterpillar mechanism.

5. The machine according to claim 1, wherein the tractor is provided on both sides thereof with a single running mechanism in the form of a caterpillar mechanism.

6. The machine according to claim 5, wherein a central section of the tractor located between said running mechanisms is adjustable in height.

7. The machine according to claim 6, wherein said central section comprises means for determining an admission height of concrete placed in front of the machine.

8. The machine according to claim 1, wherein the height of said levelling section is adjustable.

9. The machine according to claim 8, wherein adjustment of the height of said levelling section is independent of adjustment of the height of said central section of the tractor.

10. The machine according to claim 7, wherein a vertically adjustable mechanism is fitted between the tractor and the levelling section, said machine further comprising means for adjusting the height as a function of a quantity of concrete admitted by said levelling section and quantity of concrete admitted by said vertically adjustable mechanism.

11. The machine according to claim 1, wherein the distance between the levelling section and the tractor can be adjusted, and in that an angle which the levelling section forms with the direction of movement of the tractor can be adjusted.

12. The machine according to claim 11, wherein the levelling section is connected by means of a piston cylinder system to the tractor and a slewing ring fitted between this piston cylinder system and the levelling section.

13. The machine according to claim 2, wherein the tractor is provided with a caterpillar mechanism.

14. The machine according to claim 3, wherein the tractor is provided with a caterpillar mechanism.

15. The machine according to claim 2, wherein the tractor is provided on both sides thereof with a single running mechanism in the form of a caterpillar mechanism.

16. The machine according to claim 3, wherein the tractor is provided on both sides thereof with a single running mechanism in the form of a caterpillar mechanism.

17. The machine according to claim 4, wherein the tractor is provided on both sides thereof with a single running mechanism in the form of a caterpillar mechanism.

18. The machine according to claim 13, wherein the tractor is provided on both sides thereof with a single running mechanism in the form of a caterpillar mechanism.

19. The machine according to claim 14, wherein the tractor is provided on both sides thereof with a single running mechanism in the form of a caterpillar mechanism.

20. A machine for paving concrete paths with a concrete mix that is in a plastic condition by spreading the concrete mix over a certain width and leveling the concrete mix to a certain height, said machine comprising:

a tractor having a direction of movement, said tractor having a working width that is adjustable in a continuous manner;

a leveling section connected to said tractor, said leveling section having a working width that is adjustable in a continuous manner;

wherein said tractor and said leveling section are arranged such that the working width of said tractor and the working width of said leveling section are adjustable independently of each other;

wherein said leveling section is suspended on said tractor by two pairs of piston cylinder systems, with one pair of said two pairs of piston cylinder systems being located on each side of said machine with respect to a centerline of said tractor that extends in the direction of movement of said tractor, and with each piston cylinder system of said two pairs of pistons cylinder systems extending at an angle with respect to the direction of movement of said tractor.

21. The machine of claim 20, wherein said tractor has two caterpillar mechanisms, one on each side of said machine, such that adjustment of the working width adjusts the width between said two caterpillar mechanisms.

22. The machine of claim 20, wherein each one pair of said two pairs of piston cylinder systems has each piston cylinder system thereof at a different angle with respect to the direction of movement of said tractor.

* * * * *